United States Patent [19]

Ballo

[11] Patent Number: 4,516,489

[45] Date of Patent: May 14, 1985

[54] APPARATUS FOR CRUSHING ARTICLES

[75] Inventor: James A. Ballo, Elm Grove, Wis.

[73] Assignee: Balcon Industries, Menomonee Falls, Wis.

[21] Appl. No.: 391,581

[22] Filed: Jun. 24, 1982

[51] Int. Cl.[3] ..... B30B 9/32

[52] U.S. Cl. ..... 100/98 R; 100/100; 100/139; 100/156; 100/902

[58] Field of Search ..... 100/43, 45, 72, 98 R, 100/100, 138, 139, 156, 210, 902; 209/548, 593, 595, 645, 646, 930; 222/162, 169, 266; 241/97

[56] References Cited

U.S. PATENT DOCUMENTS

| | | | |
|---|---|---|---|
| 3,348,678 | 10/1967 | Flowers | 209/595 |
| 3,749,993 | 7/1973 | Laman | 209/548 |
| 3,776,128 | 12/1973 | Morris | 100/902 |
| 4,358,995 | 11/1982 | Ballo et al. | 100/100 |

*Primary Examiner*—Harvey C. Hornsby
*Assistant Examiner*—Arthur D. Dahlberg
*Attorney, Agent, or Firm*—Andrus, Sceales, Starke & Sawall

[57] ABSTRACT

An apparatus for crushing articles, such as aluminum beverage cans. The crushing apparatus includes a primary crusher followed by a secondary crusher. The primary crusher is composed of a rotatable, polygonal-shaped drum having a blade mounted on each flat surface which projects outwardly beyond the surface. The articles or cans to be crushed are introduced into the area between the drum and a spring loaded pressure plate, and on rotation of the drum, the blades engage the articles and move them into the nip between the drum and the pressure plate to provide a primary stage of flattening of the cans. The cans are then delivered to the secondary crusher which comprises a pair of cooperating rolls, which more fully crush or flatten the cans and deliver them to a pneumatic discharge conveyor. The apparatus also includes a feed conveyor having a provision for rejecting steel cans, as well as heavy objects, such as cans filled with liquid or foreign materials.

12 Claims, 10 Drawing Figures

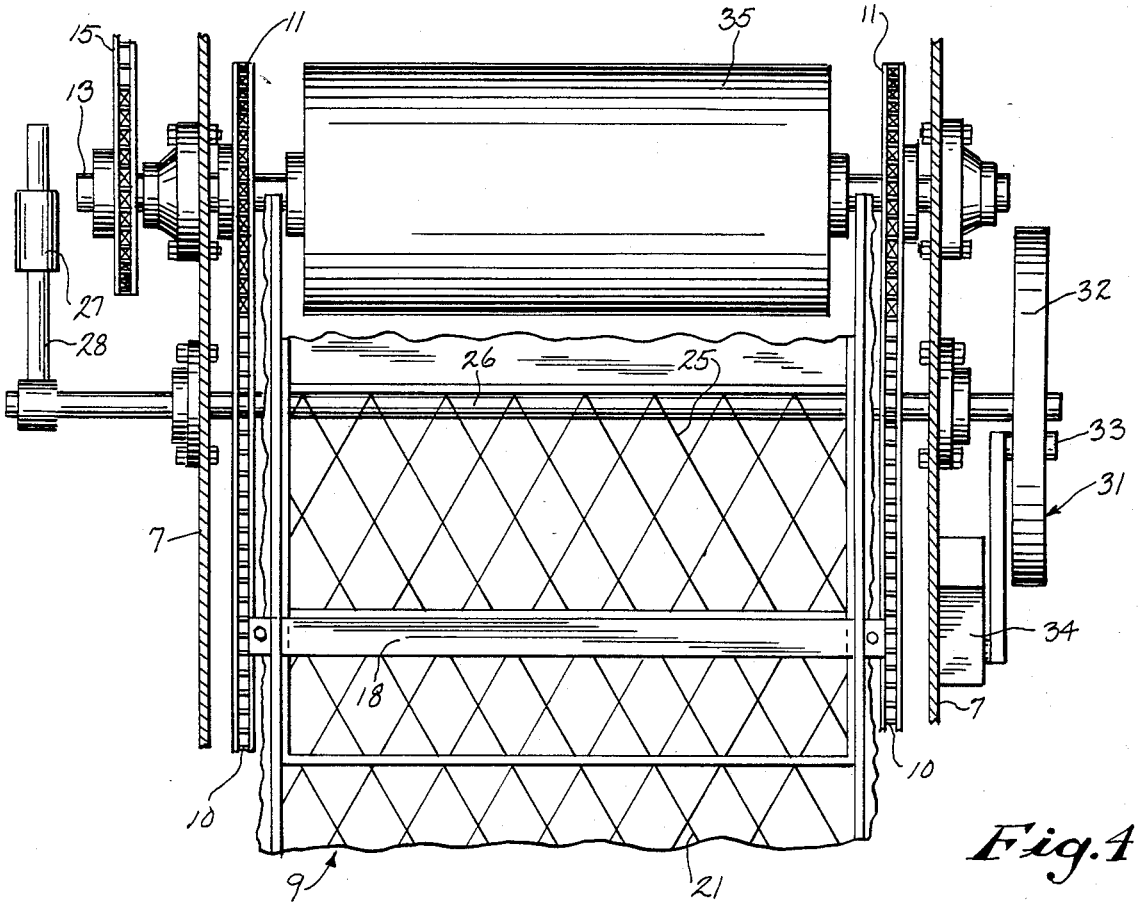
Fig.4
Fig.5
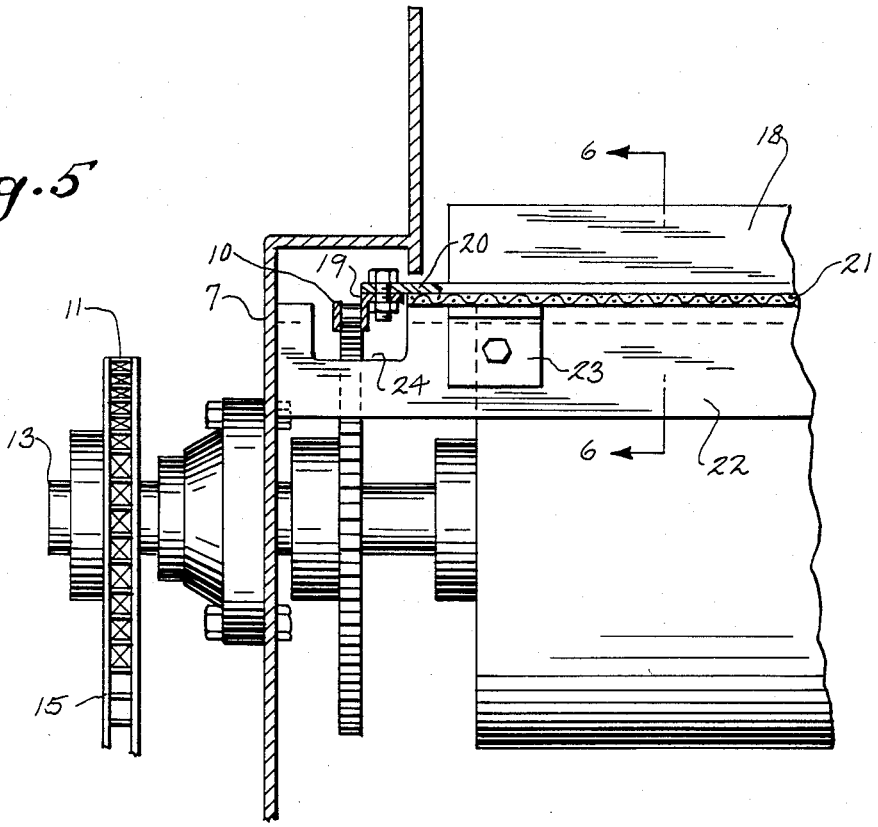

APPARATUS FOR CRUSHING ARTICLES

BACKGROUND OF THE INVENTION

In recent years there has been increased interest in reclaiming aluminum cans, such as those used for soft drinks and beer. At reclamation distribution locations the cans are crushed or flattened to reduce the volume for shipment. The can crushers, as used in the past, have generally consisted of a large rubber-covered drum that cooperated with a rotating steel drum having angle-shaped blades. The cans are introduced into the area between the drums and the angle-shaped blades moved the cans into the nip between the drums where the cans were crushed or flattened. Can crushers of this type have had certain disadvantages. The rubber-covered drum was readily damaged by sharp materials thereby requiring down time for maintenance and repair.

More recently, can crushers of the type shown in U.S. Pat. No. 4,358,995, have been used. Crushers of the type shown in the aforementioned patent application, include a rotatable polygonal-shaped drum composed of a series of flat outer surfaces. Sharpened blades are mounted flatwise on each surface and project circumferentially beyond the respective surface.

In crushers of this type, the cans to be crushed are introduced into the area between the drum and a spring loaded pressure plate, and on rotation of the drum, the blades engage the cans and move the cans into the nip between the drum and the plate to crush or flatten the cans.

While can crushers of the type described in the aforementioned patent application have been very successful in crushing or compacting aluminum cans, there has been a need to further increase the compacted density of the cans to reduce the volume of the cans for shipment. In the past, the compacted cans have been trucked from the reclamation site to a baler where the cans are further compressed into bales and then shipped to the refineries. By providing denser, more fully compressed cans, the crushed cans can be transported directly to the refinery by truck, which eliminates the operation of baling.

At the reclamation sites it has also been found that a portion of the cans being reclaimed contain material, such as liquid, dirt, stones, or the like, which increases the weight of the can being reclaimed and thus increases the amount paid to the person returning the cans. Not only does the contained material provide a false indication of the weight of aluminum, but dirt and other foreign materials in the cans can cause serious abrasion problems to the crushing rolls or drums used in the crushing apparatus, and dirt, once crushed into the can, causes contamination in the remelting process.

SUMMARY OF THE INVENTION

The invention is directed to an improved crushing apparatus for crushing articles, such as aluminum cans. The cans or other articles to be crushed are initially fed to a primary crusher composed of a rotatable polygonal-shaped drum having a series of flat outer surfaces which support sharpened blades, similar to the crushing apparatus disclosed in U.S. Pat. No. 4,358,995, The cans are introduced into the area between the drum and a spring loaded pressure plate, and on rotation of the drum, the blades engage the cans and move them into the nip between the drum and the plate to crush or flatten the cans.

The crushed can are then fed along a flat baffle plate to a secondary crusher which comprises a pair of cooperating rolls or drums. The secondary crusher serves to further reduce the compacted density of the cans and the fully compacted cans are then discharged to a pneumatic conveyor that functions to deliver the cans to a collection site.

The feed apparatus, which feeds cans to the primary crusher, has a provision for automatically rejecting heavy objects, such as cans filled with foreign material. The rejection mechanism is incorporated with a feed conveyor that comprises a pair of spaced parallel chains which carry a plurality of cleats. In the conveying run the cleats ride upwardly on a perforated support, so that dirt and other foreign materials can fall from the cans through the support prior to the cans being introduced into the primary crusher.

The perforated support also includes a pivoting section which is counterweighted to a closed position. In the event a heavy object, such as a can filled with dirt or liquid, is moved over the pivoting section, the weight of the heavy object will pivot the section to the open position to thereby discharge the heavy object to a rejection chute.

The feed conveyor also incorporates a mechanism for automatically rejecting steel cans. The upper end of the feed conveyor includes a magnetic pulley and the steel cans will be attracted to the magnetic pulley while aluminum cans will not be attracted to the pulley and will fall from the upper end of the conveyor for delivery to the primary crusher. The steel cans are dislodged from the magnetic pulley by a scraper blade and are then conducted to the rejection chute.

The invention provides two stages of crushing with the initial stage serving to crush the cans to a density in the range of about 6–8 lbs./cubic foot, while the secondary stage of crushing will further compact the cans to a density of about 12–16 lbs./cubic foot. With cans compressed to this latter density, it is not necessary to bale the cans prior to transporting to a refinery or smelter and the cans can be transported to the refinery in trucks or other vehicles.

The apparatus also tends to separate dirt and other foreign materials from the cans as the cans are being fed to the primary crusher and also will automatically reject heavy objects, such as partially filled cans, and steel cans from the aluminum cans prior to primary crushing. By separating dirt and foreign material from the cans, and by ejecting cans which may be filled with dirt and other foreign substances, abrasion of the crushing drum and rolls is minimized, thereby providing a substantially longer service life for the crushing apparatus.

Other objects and advantages will appear in the course of the following description.

DESCRIPTION OF THE DRAWINGS

The drawings illustrate the best mode presently contemplated of carrying out the invention.

In the drawings:

FIG. 4 is a view taken along line 4—4 of FIG. 2;

FIG. 5 is a transverse section taken of the feed conveyor;

DESCRIPTION OF THE ILLUSTRATED EMBODIMENT

Figure 1:
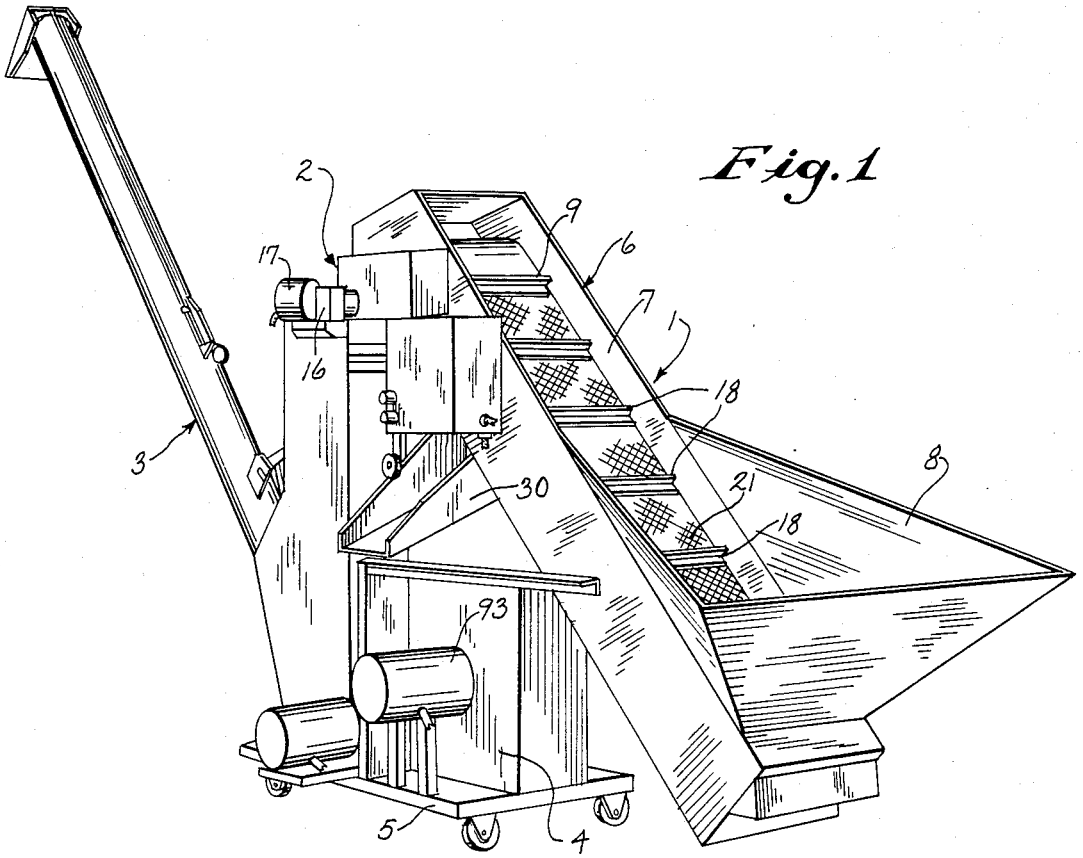
FIG. 1 is a perspective view of the crushing apparatus of the invention.
Figure 3:
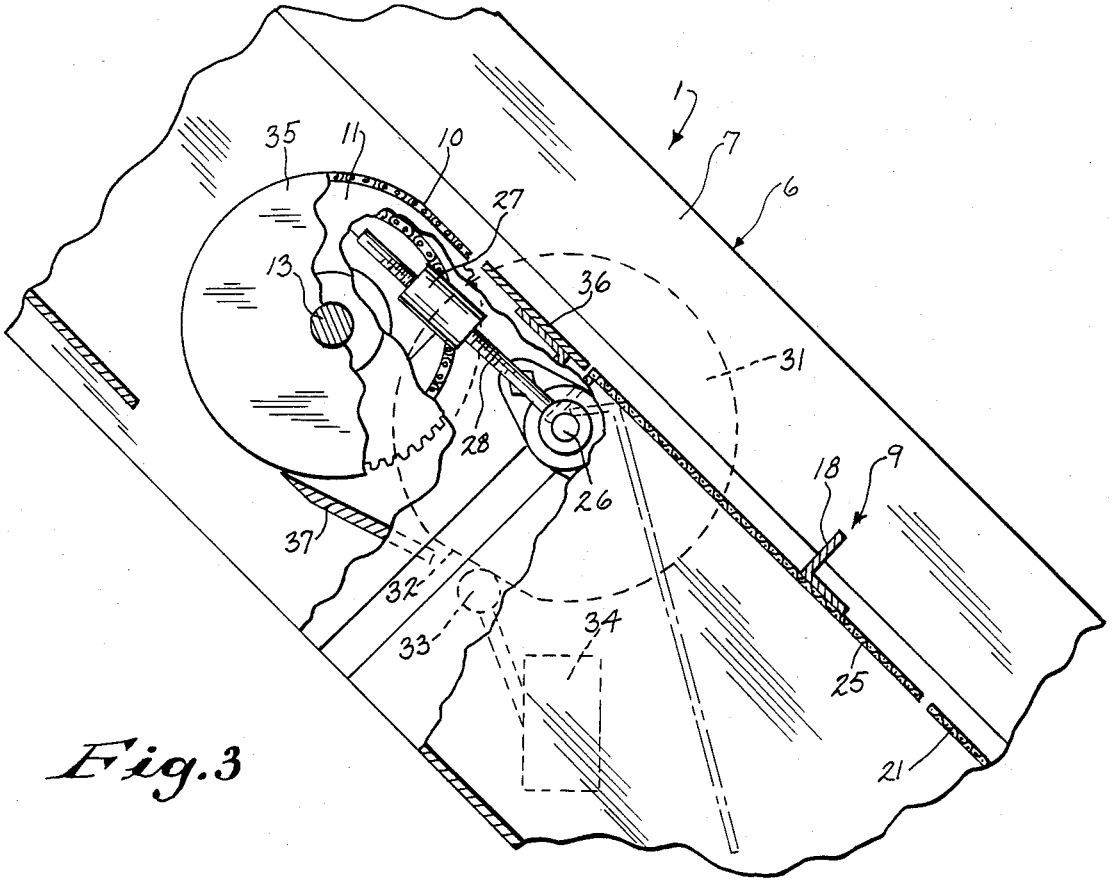
FIG. 3 is an enlarged side elevation with parts broken away showing the heavy object reject mechanism.

The apparatus of the invention, as shown in FIG. 1, includes a feed conveyor unit 1 that receives articles to be crushed, such as aluminum beverage cans of glass bottles, and conveys the articles upwardly to the upper end of a crushing unit 2 where the cans are crushed or flattened. The crushed articles are then discharged from the crushing unit 2 through an inclined discharge tube 3 through operation of a blower unit 4.

The feed conveying unit 1, crushing unit 2 and discharge tube 3 and can be mounted on a mobile base 5 which is supported by suitable castors or wheels, so that the entire apparatus can be moved from site to site.

Feed conveying unit 1 includes a housing 6 having a pair of spaced side walls 7. The lower end of the side walls 7 are flared outwardly and define a hopper 8 into which the cans or other articles are deposited.

Located within the housing 6 is an endless conveyor 9 which serves to convey the cans upwardly and deliver the cans to the upper end of the crushing unit 2. The conveyor 9 includes a pair of generally parallel endless chains 10, each of which is mounted for travel on a pair of sprockets 11 and 12. Upper sprockets 11 are mounted on shaft 13, while the lower sprockets are mounted on shaft 14. The shafts 13 and 14 are suitably journalled within bearing assemblies carried by the side walls 7 of the housing.

To drive the chains 10, the upper shaft 13 is connected through a chain drive 15 to the output shaft of a conventional gear box 16, and the input of the gear box is connected to the output shaft of a variable speed motor 17. The motor 17 and gear box 16 are mounted on the crushing unit 2. With this construction, operation of the motor 17 will act through the chain drive 15 to drive the shaft 13 and thus move the chains in an endless path of travel.

Secured to the chains 10 are a plurality of spaced cleats 18. To connect the cleats 18 to the chains 10 a series of angle brackets 19 are mounted to the respective chains and the laterally extending flanges of the brackets 19 are connected to the bases 20 of the respective cleats.

The cleats 19 are adapted to ride in the conveying run on an open or perforated support 21 which can be formed of expanded metal. As the cans or other articles are conveyed upwardly by the cleats 18, any foreign materials or dirt contained on the cans will fall by gravity through the expanded metal support 21 and will not be carried into the crushing unit.

Figure 6:
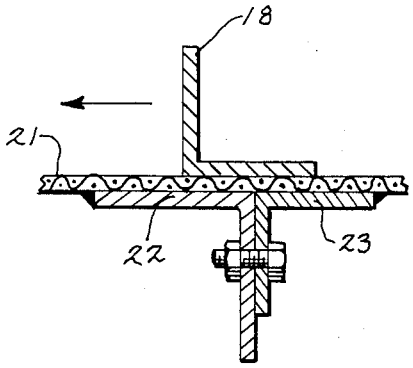
FIG. 6 is a section taken along line 6—6 of FIG. 5.

The support 21 is mounted on a series of transverse angle supports 22, the ends of which are welded to the side wall 7 of the housing and the support. A series of angle brackets 23 are welded to the lower surface of the expanded metal support 21 and are bolted to the vertical flanges of the supports 23, as best shown in FIG. 6. As shown, the expanded metal support 21 rests on the upper flanges of both the supports 22 and 23. With this construction, the grating 21 can be disconnected from the supports 22 and replaced, if necessary.

As best shown in FIG. 5, the ends of the angle supports 22 are provided with notches 24 which receive the upper run of the respective chains 10.

The support or grating 21 includes a pivotable section 25 which is located adjacent the upper end of the housing 6. The upper end of the section 25 is mounted on a transverse shaft 26 which is journalled in the side wall 7 of the housing. The section 25 is urged to a closed position, in which it is substantially flush with the grating 21, by a counterweight 27, which is adjustably mounted on a rod 28 which is secured to shaft 26 and extends upwardly from the shaft in the opposite direction from section 25. The counterweight 27 will urge the section 25 to a closed position, and by threadedly adjusting the counterweight 27 along the length of the rod 28, the force required to open the section 25 can be varied. The counterbalancing force on the pivoting section 25 is arranged so that if a heavy object, such as a can filled with liquid or dirt, is conveyed up the grating 21 by cleats 18, the weight of the object will overcome the counterbalancing action to move the section 25 to the open position and permit the heavy object to drop downwardly from the grating 21. Baffle 29 is mounted transversely between the side wall 7 beneath the grating 21 and serves to direct the rejected heavy objects onto an inclined chute 30 which conveys the objects laterally of the housing 6 to a container or bin where the heavy objects can be collected.

The crushing apparatus also has a provision for stopping operation of the conveyor 9 when a heavy object is rejected. In this regard, a cam 31 is mounted on the shaft 26 and is provided with a cam surface 32, and arm 33 of limit switch 34 is adapted to ride on the cam surface. When the door or section 25 is swung to the open position by the weight of a heavy object, the cam 31 will rotate and the arm 33 will ride along the cam surface 32 to thereby trip the limit switch 34 and send a signal to motor 17 to stop the operation of the conveyor. The weighted can or other heavy object can then be removed from the collection bin and separately weighed, and the weight deducted from the overall weight of the aluminum cans being brought to the reclamation site.

Figure 2:
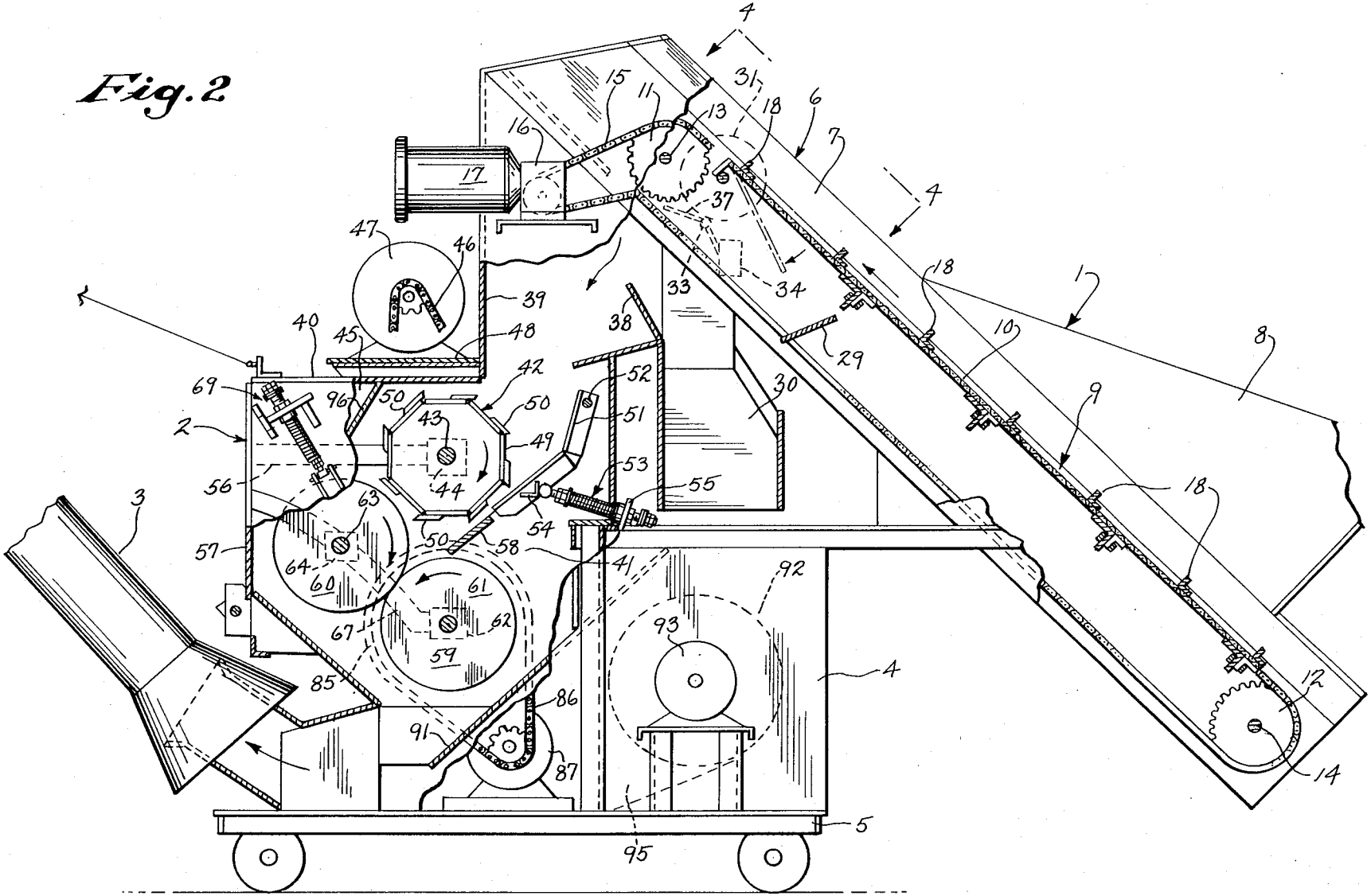
FIG. 2 is a vertical section of the apparatus with parts broken away.

The conveyor 9 also has a provision for rejecting steel cans. In this regard, the upper shaft 13 carries a magnetic pulley 35 and a spacer plate 36 extends between the upper end of the pivoting section 25 and the pulley 35. The cans are carried across the spacer plate 36 by the cleats 18, and as the cleats pass around the pulley 35, the aluminum cans will drop downwardly from the conveyor to the crushing unit 2, while the steel cans, which are attracted to the pulley 35, will ride around with the pulley and are scraped from the pulley surface by scraper plate 37 which extends between side walls 7. The steel cans then fall downwardly and are directed by the baffle 38 into the reject chute 30. As best shown in FIG. 2, the baffle 38 extends transversely across the upper inlet section 39 of the housing 40 of the crushing unit 2.

Inlet section 39 communicates with a crushing chamber 41 defined by housing 40 and the cans passing downwardly within the inlet section are directed to a primary crushing stage which serves to provide an initial compression of the cans. The primary crushing stage can be constructed in a manner similar to that in the copending U.S. application, Ser. No. 06/183,399, filed Sept. 2, 1980, and comprises a polygonal-shaped drum 42 having a shaft 43 which is journaled within bearing assemblies 44 mounted on the side walls 45 of housing 40. One end of shaft 43 projects beyond the respective bearing assembly and is connected through chain drive 46 to motor 47 which is mounted on platform 48 on housing 40. Operation of the motor 47 will drive the drum 42, preferably at a speed of about 300 rpm in the direction of the arrow as indicated in FIG. 2.

The drum 42 is composed of a series of generally flat plates or sections 49 which are welded together to provide the polygonal shape. Blades 50 which extend longitudinally of the drum are secured to each of the flat sections 49 and project beyond the respective sections in the direction of rotation, as described in the aforementioned patent application.

A pressure plate 51 is pivotally mounted within the housing and extends the full length of the drum 42. As shown in FIG. 2, the pressure plate 51 has a generally dogleg configuration and is mounted for pivoting movement on shaft 52 which extends transversely across housing 40. A pair of quick release spring assemblies 53 of the construction in patent application Ser. No. 06/183,399 are connected to an angle iron 54, which is attached to the rear surface of the pressure plate. The spring assemblies 53, as described in the aforementioned patent application, are removably connected to lugs 55 which are connected to the outside of the housing. Through adjustment of the spring assemblies, the clearance between the lower end of the pressure plate 51 and the blades 50 can be varied, as well as the spring force which urges the pressure plate toward the drum 42.

During operation, the cans are fed by gravity into the space between drum 42 and pressure plate 51, and the drum blades engage the cans and drive them into the nip between the drum and pressure plate to compress the cans to a density generally in the range of 6 to 8 lbs./ft.$^3$. If an enlarged or incompressible mass passes into the nip and the drum 42 and the pressure plate 51, the pressure plate will move outwardly against the force of the spring assemblies to accommodate the enlargement. When the enlargement has passed through the nip, the spring assemblies will return the pressure plate 51 to its original position, as described in the aforementioned patent application.

To permit removal of the drum from the housing 1 for maintenance or replacement, the side walls 45 of housing 40 are provided with aligned slots 56 which receive the ends of shaft 43 of the drum. By disassembling the bearing assemblies 44, the shaft can be slipped outwardly through slots 56 to the open end of the housing 40 after removal of the housing end plate 57.

As best illustrated in FIG. 2, the end of the pressure plate 51 terminates at a point tangent to the drum 42 and is spaced slightly outward from the circle inscribed by the tips of the blades 50. The cans which are flattened as they pass through the nip between the drum 42 and pressure plate 51 are guided across a baffle plate 58 to the secondary stage of crushing which comprises a pair of cooperating rolls 59 and 60. The lowermost roll 59 is preferably metal surfaced and the shaft 61 of roll 59 is journaled within bearing assemblies 62 mounted on the side walls 45 of the housing.

The upper roll 60 is preferably formed with a hard rubber or plastic surface, generally having a hardness of about 90 Durometer. As in the case of roll 59, the shaft 63 of roll 60 is journaled within bearing assemblies 64 which are mounted on arms 65 that are pivotally connected to shaft 66 which extends laterally along end wall 57 of housing 40. By pivoting the arms 65 about the shaft 66, the position of the roll 60 can be varied with respect to the roll 59 for purposes of adjusting the spacing between the rolls, or alternately, to move the roll 60 to a position where materials which may be jammed between the rolls can be removed.

Figure 7:
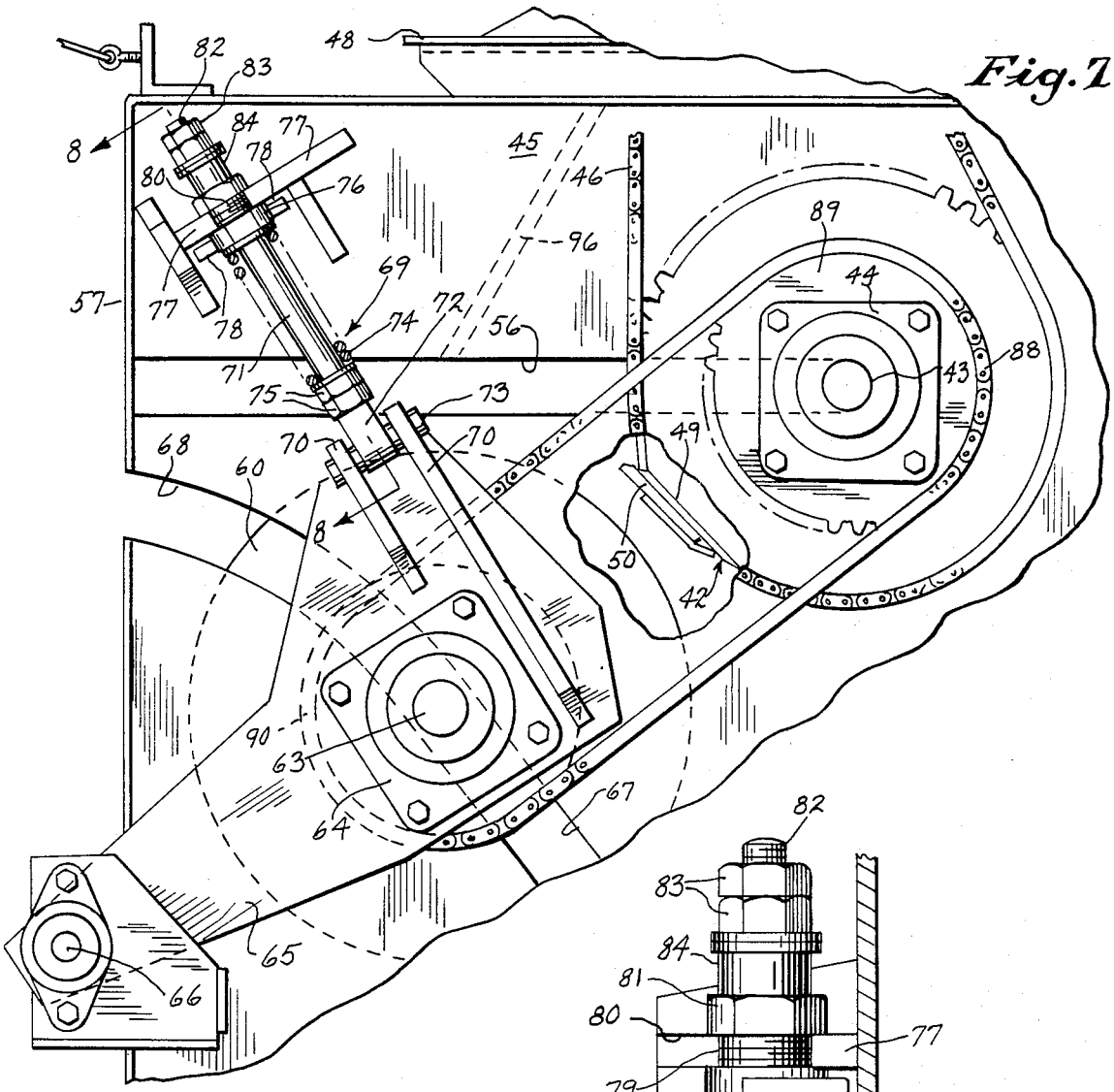
FIG. 7 is an enlarged side elevation showing the quick release mechanism for one of the compacting rolls.

To facilitate removal of the rolls 59 and 60 for maintenance or replacement, the side walls 45 are provided with aligned slots 67. As best illustrated in FIG. 7, the upper ends 68 of the slots 67 are curved about the axis of shaft 66, so that as the roll 60 is pivoted, the shaft will move within the curved portion 68 of the slot, thereby enabling roll 60 to be removed from housing 40. To remove roll 59, the bearing assemblies 62 are disconnected from side walls 45 and the shaft 61 can then be moved upwardly though slot 67 to the open rear end of the housing.

A pair of quick release spring assemblies 69, similar in construction to spring assemblies 53, are located on the outer surface of each side wall 45 and are engaged with the respective arms 66. To connect the spring assembly 69 to the respective arms 65, the outer surface of each arm is provided with a pair of spaced parallel lugs 70 and the end of a shaft 71 is provided with an eye 72 which is pivotally connected to the lugs 70 by a pin 73.

Spring 74 is mounted on the shaft 71 and extends between adjusting nuts 75 which are threaded on the end of shaft 71 and nut 76. Nut 76 bears against the surfaces of a pair of fixed walls 77 which extend outwardly from the side wall 45 of the housing. Nut 76 is provided with a pair of outwardly extending ears 78 which, through engagement with the outer surface of the side wall 45, will prevent rotation of the nut 76 with respect to the shaft 71. Nut 76 is threaded on the inner end of a sleeve 79 and the sleeve extends freely through a slot 80 between the spaced walls 77. Nut 81 is threaded on the sleeve 79, on the opposite side of walls 77.

Figure 8:
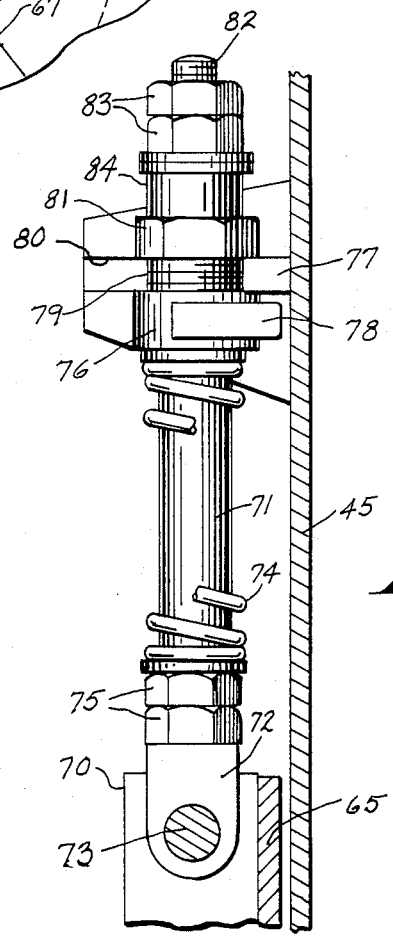
FIG. 8 is a section taken along line 8—8 of FIG. 7.

As best shown in FIG. 8, the outer end of shaft 71 has a reduced diameter, as indicated by 82, and the reduced diameter portion extends freely through the central bore of the sleeve 79. The outer threaded end of the shaft extension 82 receives adjusting nuts 83 and a resilient washer assembly 84 is interposed between the innermost nut 83 and the end of sleeve 79.

With this construction, threaded adjustment of the nuts 75 will vary the force of the compression spring 74, while adjustment of the nuts 83 will adjust the clearance between the rolls 59 and 60.

The rolls 59 and 60 are driven at a slightly faster rate of speed than the speed of rotation of the drum 42, so that the cans will be drawn away from the primary crushing area. To drive the roll 59, a sprocket 85 is connected to one end of the shaft 61 and is connected through a chain drive 86 to a motor 87, which is mounted on the base 5. The roll 60 is driven from the drum 42 and in this regard, a chain drive 88, connects a sprocket 89 on the end of the shaft 43 with a sprocket 90 on the end of roll shaft 63. By proper selection of the diameter of the sprockets, the rolls 59 and 60 can be driven at the desired rate of speed.

During operation, if an enlarged or incompressible mass passes into the nip between the rolls 59 and 60, the roll 60 will move outwardly against the force of spring 74 to accommodate the enlargement. When the enlargement is passed through the nip, the spring 74 will return the roll 60 to its original position.

As in the case of the spring assemblies 53, the spring assemblies 69 provide a quick release which enables the operator to readily release the roll 60 to clear an obstruction if it is jammed between the rolls. To provide the quick release, the operator loosens the nut 81 and the entire spring assembly can then be pivoted about the pin 73, to lift the nut 76 out of engagement with the fixed wall 77. When the nut 76 has cleared the wall 77, the spring assemblies 69 and roll 60 can be pivoted upwardly away from the roll 59 to remove the obstruction. During this pivotal movement, shaft 63 of roll 60 will move within the curved sections 68 of slots 67.

After the secondary stage of compression, which will crush the cans to a density in the range of about 12 to 14 lbs/ft.$^3$, the cans fall downwardly within the housing onto an inclined bottom wall 91 and are delivered into the discharge tube 3 by a stream of air created by the blower unit 4. The construction of the blower unit 4 and discharge tube 3 is similar to that disclosed in the copending application, Ser. No. 06/183,399. In general, the blower unit includes a conventional fan or blower 92, which is mounted on the base 5 and is driven through a motor 93. Air is drawn into the blower 92 through a central inlet and is discharged through a tangential outlet 95 which is connected to the discharge tube 3. The cans moving downwardly along the wall 91 will be picked up in the fast moving stream of air and delivered into the tube 3 for discharge into a truck or other collection site.

As best shown in FIG. 2, the baffle plate 58 is placed a slightly greater distance from the blades 50 of drum 42 than the pressure plate 51 and this spacing aids in delivering the crushed articles to the cooperating rolls 59 and 60. In the event of jam-up occurs in the secondary crushing stage, the sharpened tips of the blades 50 of drum 42 will carry the partially crushed cans upwardly around the drum 42. Baffle 96 is disposed within the housing and is located outwardly of drum 42 and serves to deflect the cans upwardly around the drum, so that the cans will be recirculated back to the space between the drum 42 and the pressure plate 59. Thus, if a slowdown or stoppage occurs in the secondary crushing stage, the cans will be automatically recirculated back to the first crushing stage.

The invention provides a two-stage crushing operation in which the cans, or other articles, are crushed to a highly compacted density generally in the range of 12 to 14 lbs./ft$^3$. With this density, it is economically feasible to transport the compacted cans to a refinery or smelter, without the necessity of further compressing and baling the cans.

The invention, through the quick release spring mechanisms, enables the pressure plate 51 in the first crushing stage and the roller 60 in the secondary crushing stage to be readily released and moved away from the cooperating crushing element to relieve jamming. In addition, through the use of the slots 56 and 67 in the side walls 45 of the housing, both the drum 42 and the crushing rolls 59 and 60 can be readily removed from the housing for maintenance or replacement.

By rejecting heavy cans that may be filled with dirt or other foreign material, as well as removing surface dirt and foreign materials through use of the grating 21, abrasive wear on the crushing elements is substantially reduced, thereby providing a longer service life for the crushing apparatus.

Figure 9:
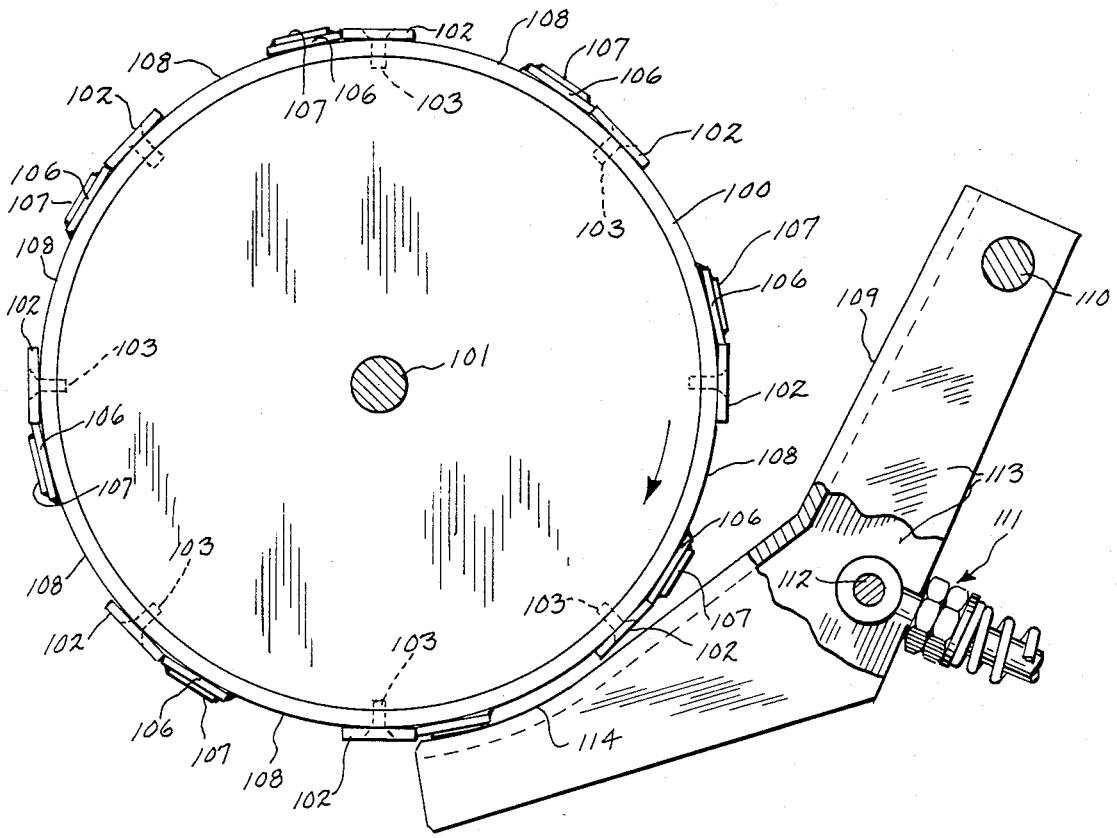
FIG. 9 is a transverse section showing a modified form of the primary stage crushing roll.
Figure 10:
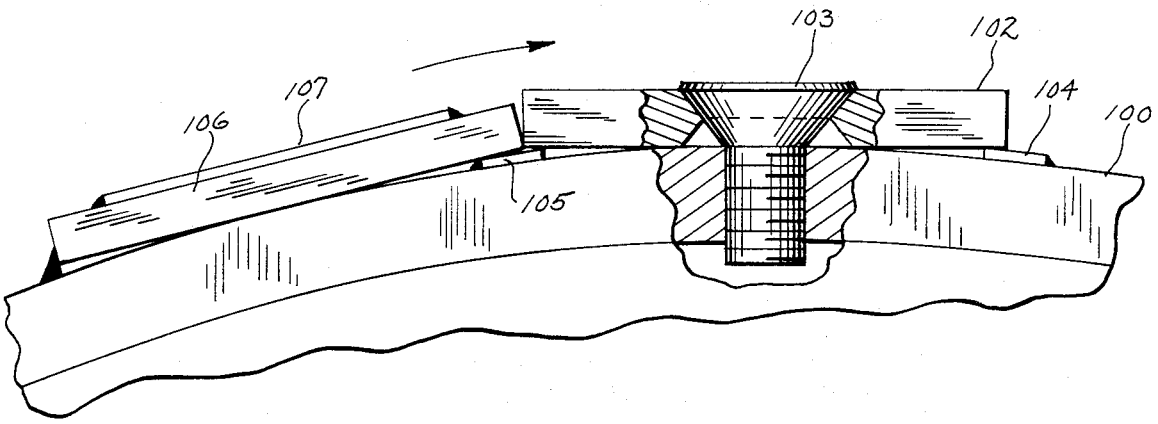
FIG. 10 is an enlarged fragmentary view of the roll construction of FIG. 9.

FIGS. 9 and 10 illustrate a modified form of the primary stage crushing roll. In this embodiment the crushing roll comprises a cylindrical drum 100 having a shaft 101 which is journalled within suitable bearing assemblies on the side walls of housing 40. The drum 100 can be rotated about its axis in the manner described with respect to drum 42 of the first embodiment.

A series of crushing bars or blades 102 are secured to the outer surface of drum 100 by screws 103 and each bar 102 extends the length of the drum. As the bars 102, as shown in FIG. 10, are flat and the drum 101 is cylindrical in shape, the leading and trailing edges of each bar are spaced outwardly of the drum surface, and shims 104 and 105 are driven into the spaces and welded to the drum surface. With this construction the crushing bars 102 are firmly secured to the drum 100, yet can be readily removed for replacement or repair.

To aid in compacting the cans or other articles, a compacting bar 106 is secured to the drum behind, with respect to the direction of rotation of the drum, each crushing bar 102. The bars 106 extend the length of the drum and the leading edge of each bar 106 is supported on shim 105. The leading edges of bars 106 have a lesser thickness than the trailing edges of the adjacent crushing bars 102, and to effect a greater compacted density for the cans, pads 107 can be welded to the outer surface of each compacting bar 106.

As shown in FIG. 9, the leading edge of each crushing bar 102 is spaced from the trailing edge of the adjacent compacting bar 106 to provide a recess 108 of sufficient circumferential dimension so that a can oriented with its axis parallel to the drum axis can fit within the recess.

A pressure plate 109, similar in construction and function to pressure plate 51 of the first embodiment, is pivotally mounted on shaft 110 which extends transversely across the housing 40. A pair of quick release spring assemblies 111, similar to spring assemblies 53, are connected to rod 112 which is attached between ribs 113 that project rearwardly of the pressure plate. Through adjustment of spring assemblies 111, the clearance between the lower end of pressure plate 109 and drum 100 can be varied, as well as the spring force which urges the pressure plate toward the drum.

Pressure plate 109 has a dog-leg shape, with the lower end being curved, as indicated by 114, to conform to the curvature of drum 100 which aids in the compaction of the cans.

In operation, the cans are fed by gravity into the space between drum 100 and pressure plate 109, and the leading edges of crushing bars 102 engage the cans and drive them into the nip between the drum and the pressure plate. The trailing compacting bars 106 further densify the crushed cans to provide a compacted density of about 10 to 12 lbs/ft$^3$ in a single stage operation.

The drum 100, as illustrated in FIGS. 9 and 10, can be used as a primary crushing stage in conjunction with the compaction rolls 59 and 60, or alternately, drum 100 can be used as the sole crushing stage, without the secondary stage.

The drum construction of FIGS. 9 and 10 is less expensive to fabricate than a polygonal-shaped drum formed of a series of flat plates, and yet the manner of attachment of crushing bars 102 provides projecting leading edges which will effectively engage the cans and drive them into the nip.

As a further advantage, the drum 100 can be produced with an accurately machined outer surface, with the result that the crushing bars or blades 102 are precisely positioned with respect to the axis of rotation of the drum, thereby producing more uniform compaction of the cans.

Various modes of carrying out the invention are contemplated as being within the scope of the following claims particularly pointing out and distinctly claiming the subject matter which is regarded as the invention.

I claim:

1. An apparatus for crushing articles, comprising a housing, first stage crushing means disposed within the housing and disposed to receive and crush a plurality of said articles, second stage crushing means located within the housing to receive partially crushed articles from said first stage and to provide a secondary stage of crushing, delivery means for delivering the partially crushed articles from said first stage crushing means to the second stage crushing means, recirculating conduit means for conducting partially crushed articles from a location between said first and second crushing means to a second location upstream of said first crushing means, and means associated with said first crushing means for moving said articles through said recirculation conduit means during periods when said second crushing means cannot accommodate the flow of partially crushed articles.

2. The apparatus of claim 1, wherein said first crushing means comprises a polygonal-shaped drum mounted for rotation within the housing and having a plurality of generally flat interconnecting surfaces, said drum having blades connected flatwise to a plurality of said surfaces and said blades projecting forwardly in the direction of drum rotation from said respective surfaces, said first crushing means also including a pressure member disposed adjacent the drum to provide a converging space therebetween wherein said articles to be crushed are introduced into said converging space and are engaged by said blades which carry said articles into the nip between the drum and the pressure member to thereby crush and flatten said articles, said second crushing means comprising a pair of cooperating rolls.

3. The apparatus of claim 2, wherein said recirculating conduit means includes a baffle disposed within the housing and located outwardly of said drum to direct said partially crushed articles to said upstream position, said blades comprising said means for moving said articles through said recirculating conduit means.

4. The apparatus of claim 2, wherein said pressure memeber is pivotally connected to said housing and has a free end that terminates at a point generally tangent to said drum, said delivery means comprising a guide member disposed adjacent the free end of said pressure member and positioned to guide the partially crushed articles to said cooperating rolls.

5. The apparatus of claim 2, and including adjusting means for adjusting the spacing between said rolls.

6. The apparatus of claim 5, and including a pair of arms pivotally connected to said housing, one of said rolls having a shaft, said shaft being journaled within said arms, said adjusting means being operably connected to one of said arms to pivot said arms with respect to the housing and thereby adjust the spacing between said rolls.

7. The apparatus of claim 6, wherein said housing is provided with a pair of spaced side walls and said arms are located outwardly of the respective side walls, said side walls having aligned slots to receive the respective ends of said shaft, said slots having curved sections disposed on a radius of the pivotal axis of said arms, whereby said shaft can move within the curved sections of said slots as said arms are pivoted.

8. An apparatus for crushing articles, comprising a housing having an inlet to receive articles to be crushed, feed conveyor means for feeding articles to said inlet, rejection means operably associated with said feed conveyor means for rejecting heavy articles having a weight more than a pre-set value from said conveyor means, first stage crushing means disposed within said housing adjacent said inlet and disposed to receive and crush a plurality of said articles, second stage crushing means located within the housing to receive partially crushed articles from said first stage and to provide a secondary stage of crushing, delivery means for delivering the partially crushed articles from said first stage crushing means to the second stage crushing means, recirculating means for conducting partially crushed articles from a location between said first and second crushing means to a second location upstream of said first crushing means, means associated with said first crushing means for moving said articles through said recirculating conduit means during periods when said second crushing means cannot accommodate the flow of partially crushed articles, and discharge means for receiving the crushed articles from said second stage crushing means and discharging the crushed articles to a collection site.

9. The apparatus of claim 8, and including a rejection site, and means for conducting rejected heavy articles to said rejection site.

10. The apparatus of claim 8, wherein said first crushing means comprises a polygonal-shaped drum mounted for rotation within the housing and having a plurality of generally flat interconnecting surfaces, said drum having blades connected flatwise to a plurality of said surfaces and said blades projecting forwardly in the direction of drum rotation from said respective surfaces, said first crushing means also including a pressure member disposed adjacent the drum to provide a converging space therebetween wherein said articles to be crushed are introduced into said converging space and are engaged by said blades which carry said articles into the nip between the drum and the pressure member to thereby crush and flatten said articles, said second crushing means comprising a pair of cooperating rolls.

11. The apparatus of claim 8, wherein said second stage crushing means comprises a pair of cooperating rolls, drive means to rotate said rolls, adjusting means for adjusting the position of a first of said rolls with respect to the second of said rolls to thereby control the spacing between said rolls, and biasing means for urging said first roll toward said position, an enlarged mass passing into the nip between said rolls causing said first roll to move outwardly away from said second roll against the force of said biasing means to permit said mass to pass through said nip.

12. The apparatus of claim 8, and including drive means operably connected to said feed conveyor means for driving said feed conveyor means, and means responsive to actuation of said rejection means for discontinuing operation of said drive means, whereby rejection of a heavy article from said feed conveyor means will automatically stop operation of said feed conveyor means.

* * * * *